United States Patent [19]

Ielmini

[11] Patent Number: 4,687,104

[45] Date of Patent: Aug. 18, 1987

[54] MICROWAVE CARTON

[75] Inventor: Angelo Ielmini, Patterson, Calif.

[73] Assignee: Patterson Frozen Foods, Inc., Patterson, Calif.

[21] Appl. No.: 815,321

[22] Filed: Dec. 31, 1985

Related U.S. Application Data

[63] Continuation-in-part of Ser. No. 742,246, Jun. 7, 1985, abandoned.

[51] Int. Cl.[4] ..... B65D 5/54

[52] U.S. Cl. ..... 206/607; 206/611; 206/628; 206/629

[58] Field of Search ..... 206/607, 611, 612, 628, 206/629, 620

[56] References Cited

U.S. PATENT DOCUMENTS

| | | | |
|---|---|---|---|
| 2,276,577 | 3/1942 | Hahn | 229/7 R |
| 2,973,086 | 2/1961 | Thompson | 206/607 |
| 3,012,705 | 12/1961 | Thiolat | 229/39 R |
| 3,146,933 | 9/1964 | Moore | 229/31 R |
| 3,167,238 | 1/1965 | Smith | 229/51 |
| 3,219,253 | 11/1965 | Davis | 206/629 |
| 3,223,230 | 12/1965 | Bianchi | 206/45.31 |
| 3,246,829 | 4/1966 | Sexton | 229/31 R |
| 3,335,935 | 8/1967 | McCallum | 229/31 R |
| 3,357,631 | 12/1967 | Aid et al. | 229/51 |
| 3,511,429 | 5/1970 | Brian | 229/31 R |
| 3,572,576 | 3/1971 | Foster | 206/612 |
| 3,580,478 | 5/1971 | Bemiss | 206/607 |
| 3,737,095 | 6/1973 | Derauf | 229/51 TC |
| 3,786,983 | 1/1974 | Hennessey | 206/628 |
| 3,905,646 | 9/1975 | Brackmann et al. | 229/15 |
| 4,043,503 | 8/1977 | Meyers et al. | 206/613 |
| 4,411,365 | 10/1983 | Horikawa et al. | 206/607 |
| 4,449,633 | 5/1984 | Johnson et al. | 206/612 |

FOREIGN PATENT DOCUMENTS

| | | | |
|---|---|---|---|
| 990150 | 4/1965 | United Kingdom | 229/31 R |

*Primary Examiner*—Stephen Marcus
*Assistant Examiner*—Gary E. Elkins
*Attorney, Agent, or Firm*—Townsend and Townsend

[57] ABSTRACT

A folded carton includes base and top portions. The base portion has a bottom, sides and web corners to the base portion can hold liquid. The sides and web corners are temporarily maintained in the folded condition while the carton is being filled with a product by using tabs and notches in the sides and web corners. The top portion includes a top, side flaps and a front flap. Portions of the carton material are coated with a waterproof, heat sealable coating. After filling, the flaps are sealed to the sides using heat. A top flap, including a lifting tab, is creased by partially scoring outer and inner surfaces of the top and the front flap to create a frangible tear path allowing the top flap to be lifted up away from the top portion, thus exposing the contents. A portion of the front side opposite the lifting tap is recessed to aid lifting of the tab.

20 Claims, 5 Drawing Figures

MICROWAVE CARTON

This is a continuation-in-part of U.S. patent application Ser. No. 742,246 filed June 7, 1985, now abandoned.

BACKGROUND OF THE INVENTION

This invention relates to cartons, particularly a one piece carton suitable for heating frozen food in a microwave oven.

Microwave ovens have taken an often prominent place in the homeowner's kitchen. Many frozen foods, both vegetables and other foods, are quickly and conveniently heated in microwave ovens. To do so the food must be removed from the package, be it a paper carton or a foil spray, placed in a dish suitable for use in a microwave then heated. There are several reasons for this extra step. Metal objects, such as aluminum foil trays containing the food, cannot be used in the microwave ovens. Some cartons are not designed to hold liquids. Many other cartons which are designed to hold liquids are made using adhesives, which when subjected to the heat of the microwave oven can produce off-tastes and off-doors in the food.

SUMMARY OF THE INVENTION

The present invention provides a carton suitable for heating and cooking food directly in the carton in a microwave oven without leaking or producing off-tastes or off-odors.

The carton is made from a single piece of material and includes a base portion and a top portion. The base portion has a generally rectangular bottom with sides extending from the periphery of the bottom and web corners between adjacent sides. The sides and web corners are folded upwardly, preferably along creases or fold lines formed in the carton material, to form a liquid containing base portion. The sides and web corners are temporarily maintained in this folded condition while the carton is being filled with a product by using tabs and notches in the sides and web corners.

The top portion includes a rectangular top, sized to overlie the rectangular bottom, extending from an outer edge of one of the sides. The top portion includes side flaps extending from opposite edges of the periphery of the top and a front flap. After filling the bottom portion with the product, the top is folded down over bottom and the flaps are folded over and against adjacent sides. One of the surfaces of the carton material is coated with a waterproof, heat sealable coating which allows the flaps to be sealed to the sides using heat.

A top flap is created by partially scoring the outer and inner surfaces of the top and the front flap. First and second score lines, formed in the outer surface of the carton, extend from positions adjacent a top flap crease in the top to positions adjacent a lifting tab portion of the front flap. Third and fourth score lines are formed in the inner surface of the carton. The third and fourth score lines are closely spaced apart from and parallel to the first and second score lines. The score lines extend along the top, generally parallel to and closely spaced apart from the second and fourth sides of the top while the top flap crease is generally parallel to and closely spaced from the first side of the top. Therefore, the top flap overlies a substantial portion of the bottom. The score lines create a frangible tear path so that upon lifting the lifting tab, the front flap and top tear in the region between the parallel score lines allowing the top flap to be lifted up away from the top portion, thus exposing the contents.

A primary advantage of the invention is that the user can heat or cook the frozen food product in the microwave while the food remains in the carton. The present invention allows the user convenient and full access to the entire contents of the carton, by lifting the top flap, without destroying the structural integrity of the carton. Although the top flap overlies or covers a substantial portion of the bottom, lifting the top flap does not substantially impair the structural integrity of the carton since it leaves a U-shaped portion of the top intact. Also, since no separate tray is needed to heat the food, the cost of packaging is reduced significantly.

In one embodiment the transition area between the top flap and the U-shaped portion of the top is not creased or scored or otherwise weakened so that no hinge is created at this area. This allows the top flap to be used as a carrying handle when lifted up away from the heated food in the carton since the top flap is sufficiently cool to grasp and since the transition area, being full strength, keeps the carton sufficiently horizontal so the food does not spill out. In another embodiment the transition area is creased to better permit the user to eat directly from the container.

Another feature of the invention is the provision of a depressed area along the side underlying the lifting tab. This, coupled with the absence of an adhesive in the depressed area, helps the user lift the top flap away from the underlying side to which the top flap is secured. In addition, exposed portions of the carton are preferably coated with a varnish or similar material to help protect the carton from abrasion.

Other features and advantages of the invention will appear from the following description in which the preferred embodiments have been set forth in detail in conjunction with the accompanying drawings.

DETAILED DESCRIPTION OF THE PREFERRED EMBODIMENTS

Figure 1:
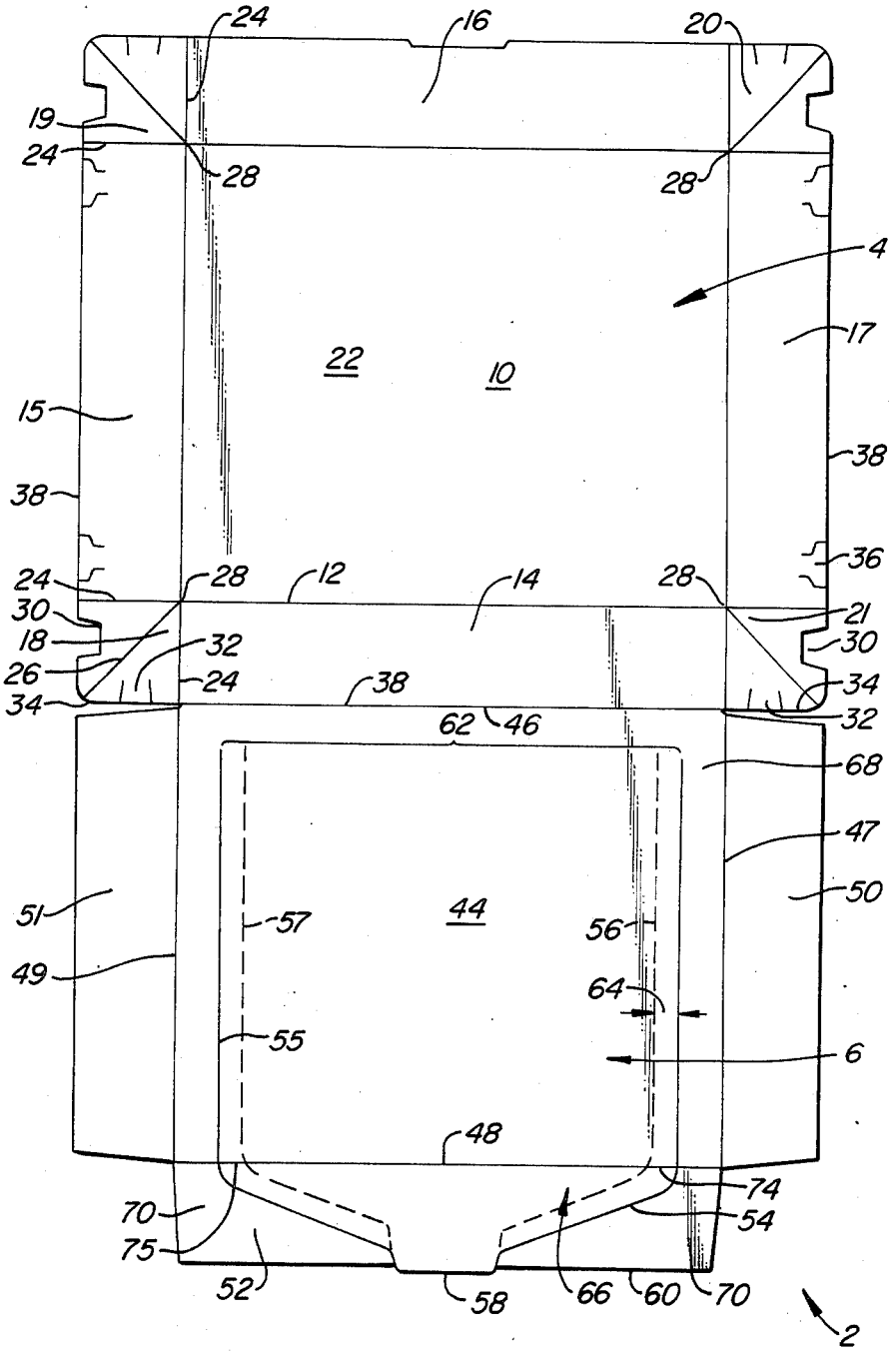
FIG. 1 shows an unfolded, flat carton blank made according to the invention.
Figure 2:
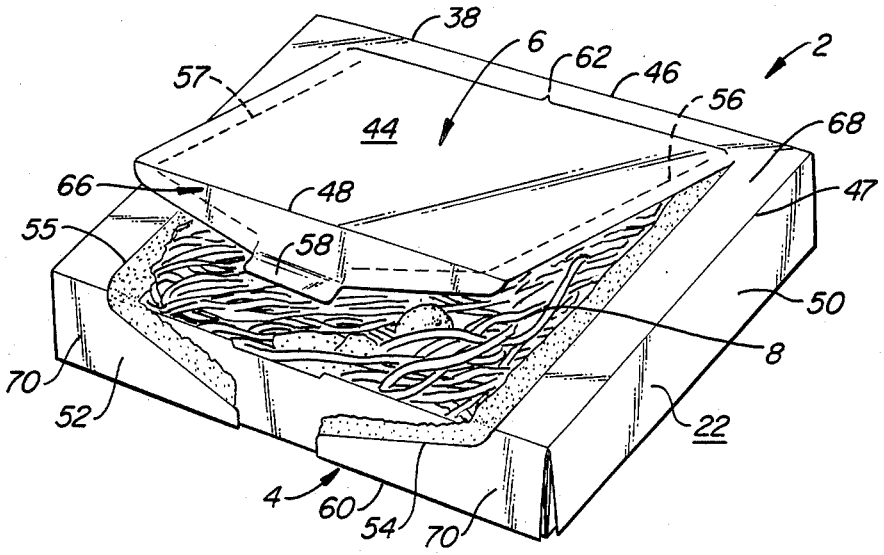
FIG. 2 is a perspective view of an assembled carton with the top flap partially lifted up exposing the contents of the carton.
Figure 3:
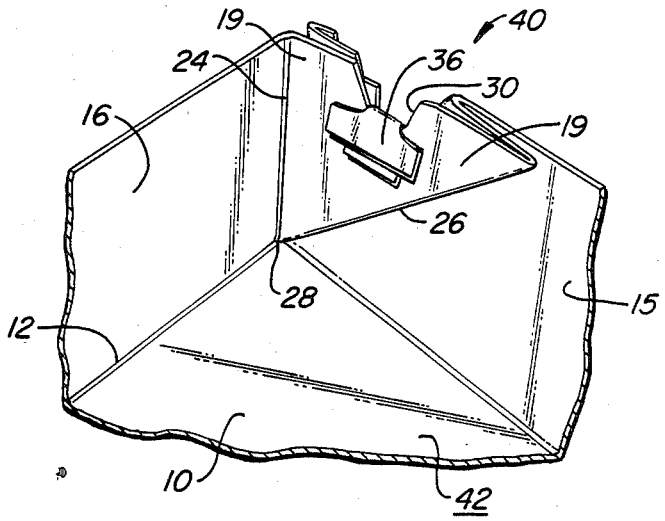
FIG. 3 is an enlarged view of a corner of the carton of FIG. 2 showing the tab and notch fastener.

Referring to FIGS. 1–3, a carton 2 includes broadly a base portion 4 and a top portion 6 which when assembled is used to contain a product such as food 8, typically frozen, in the carton for direct heating and cooking in the carton in a microwave oven, not shown, by the user.

Base portion 4 includes a rectangular bottom 10 circumscribed by a bottom periphery 12. Sides 14–17 extend from periphery 12 while web corners 18–21 extend between adjacent sides 14–17 at the corners 28 of bottom 10. The intersections of bottom 10 and sides 14–17 along bottom periphery 12 are creased inwardly from the outer surface 22 of carton 2. The intersections 24 between web corners 18–21 and adjacent sides 14–17 are creased and a diagonal crease 26 is formed in each of web corners 18–21 from corners 28 of bottom 10 to aid folding during the formation of the assembled carton of FIG. 2.

Each web corner 18–21 includes a notch 30 and notch flap 32 formed along its outer periphery 34. A T-shape tab 36 is formed along the outer edge 38 of sides 15 and 17 adjacent notches 30. Notch 30, notch flap 32 and tab 36, which together constitute tab and notch fastener 40 (see FIG. 3), are used to temporarily keep base portion 4 folded in the food containing configuration of FIGS. 2 and 3 during filling of carton 2.

Top portion 6 includes a rectangular top 44 having first, second, third and fourth edges 46–49. Top 44 is sized to overlie bottom 10. First edge 46 is coextensive with the outer edge 38 of side 14. Side flaps 50, 51 extend from second edge 47 and fourth edge 49 respectively. A front flap 52 extends from third edge 48. Edges 46–49 are creased to aid folding.

Top 44 and front flap 52 include first and second score lines 54, 55 extending partially through outer surface 22 and third and fourth score lines 56, 57 extending partially through an inner surface 42 of carton 2. Score lines 54–57 extend from a lifting tab portion 58 at an outer edge 60 of front flap 52, diagonally outwardly toward third edge 48, then toward first edge 46 parallel to second and fourth edges 49 and terminate at a top flap transition 62. Note that area 62 is full strength; that is it is not weakened by creases or score lines. First and third score lines 54, 56 and second and fourth score lines 55, 57 are parallel to one another and are spaced apart by a tear distance 64. The score lines are relatively close to, but spaced apart from second and fourth edges 47, 49 while top flap crease 62 is similarly spaced apart from first edge 46. Thus, score lines 54–57 and top flap crease 52 define a top flap 66.

Top flap 66 is used to gain access to the contents of carton 2 without the need for destroying the structural integrity of the carton. This is accomplished by grasping lifting tab 58 and pulling top flap 66 away from the remainder of the top portion 6. Doing so causes the carton material between the first and third score lines 54, 56 and between the second and fourth score lines 55, 57 to tear. However, top flap 66 leaves a U-shaped peripheral region 68 of top 44 and portions 70 of front flap 52 in place to ensure the structural rigidity and integrity of carton 2 is not unduly compromised by lifting top flap 66.

Transition area 62 is full strength; that is it is not scored or creased or otherwise weakened. Full strength transition area 62 therefore inhibits or restrains movement of top flap 66 about area 62. Therefore one can use top flap 66 of FIG. 2 as a carrying handle to lift carton 2. Even though carton 2 may contain hot food 8, top flap 66 remains cool enough to grasp. Since full strength transition area 62 inhibits flexion of top flap 66, base portion 4 of carbon 2 remains sufficiently horizontal so not to spill food 8.

In use, carton 2 in the planar configuration of FIG. 1 is folded, typically by automatic folding machines. Sides 14–17 of base portion 4 and web corners 18–21 are folded up and away from outer surface 22 of bottom 10. When sides 14–17 are generally perpendicular to inner surface 42 of bottom 10, tabs 36 and notch flaps 32 are folded inwardly to maintain base portion 4 in its folded, product containing configuration. See FIG. 3. Food 8 is then placed into base portion 4 and top portion 6 is folded over until top 44 lies generally parallel to bottom 10. Side flaps 50, 51 and front flap 52 are folded over until they lie adjacent sides 17, 15 and 14. Since outer surface 22 is covered with a water repelling, heat sealable coating, side flaps 50, 51 and portions 70 of front flap 52 are sealed to sides 17, 15 and 14 by the application of heat.

To heat food 8 in carton 2, carton 2 can be placed directly in a microwave oven without opening top flap 66 sufficiently to let steam escape, if desired. However, top flap 66 may be opened if it is desired add water first or to stir the contents before or during cooking. Top flap 66 is then closed by inserting tab 58 adjacent inside surface 42 of side 16 prior to heating. To aid doing this, score lines 56, 57 may be extended along portions 74, 75 of edge 48 between score lines 54 and 56 and between lines 55 and 57. Also, food 8 may be defrosted by filling carton 2 with water and then draining the water from the carton prior to cooking in the microwave.

Figures 4, 5:
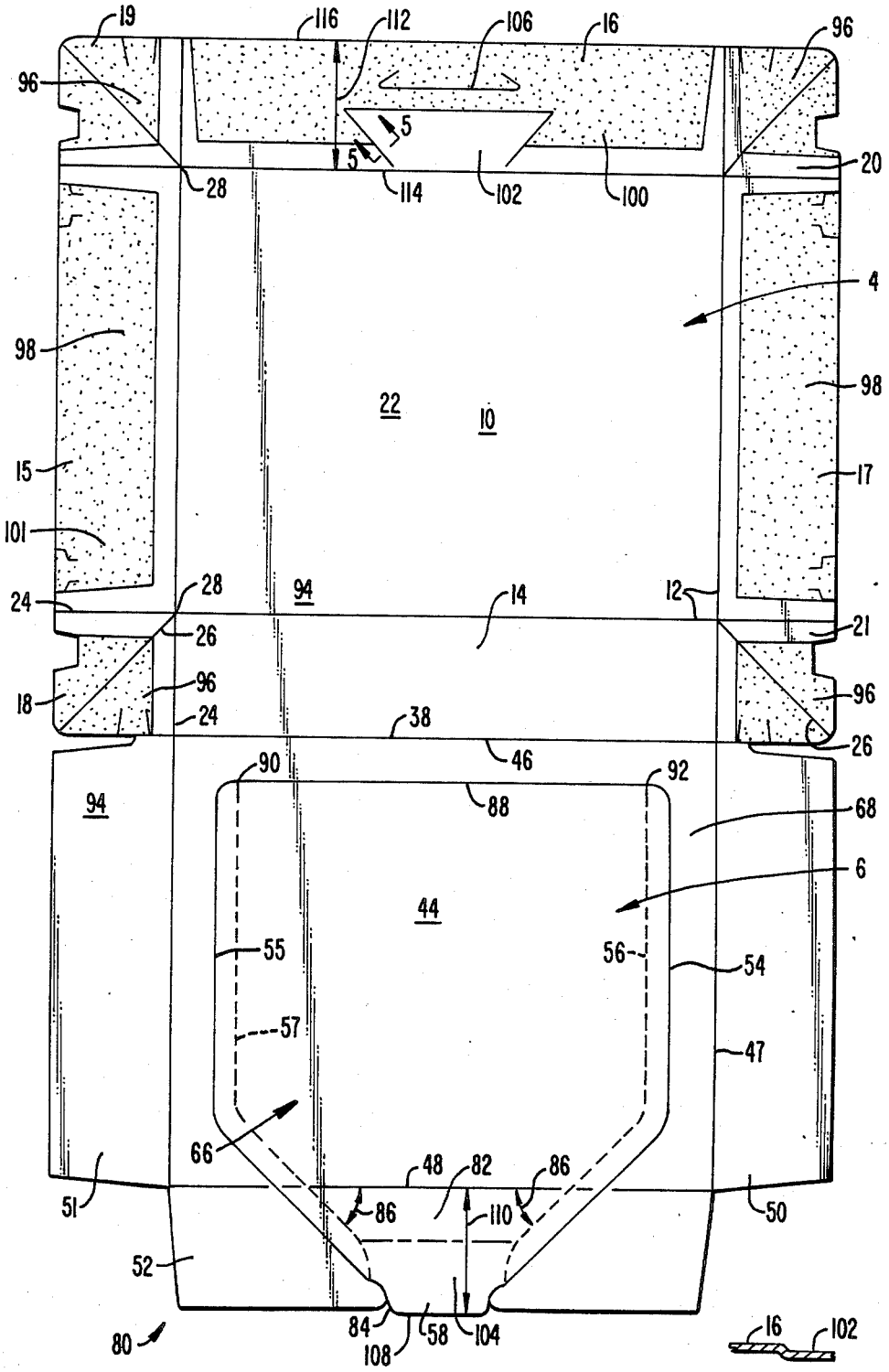
FIG. 4 shows a second embodiment of the unfolded, flat carton blank of FIG. 1.
FIG. 5 is a cross-sectional view taken along line 5—5 of FIG. 4 showing the depressed area in a side of the carton bottom.

Turning now to FIG. 4, a second embodiment of the invention is shown. Carton 80 is similar to carton 2 except as to the differences discussed below. Therefore, like elements will be identified with like reference numerals.

A portion 82 of top flap 66 coextensive with front flap 52 is modified in several aspects from the embodiment of FIG. 1. A cutaway nitch 84 is created at either side of lifting tab portion 58 to help the user grasp tab portion 58. Score lines 54, 55, 56, and 57 extend at an angle 86 which is about 45° to third edge 48, a much larger angle than in the embodiment of FIG. 1. Third edge 48 has five creased sections which do not intersect score lines 54, 55, 56, or 57. These last two changes help to ensure a proper tear between score lines 54, 56 and between score lines 55, 57 when top flap 66 is lifted.

A flap crease 88 extends between points 90, 92 at the ends of score lines 55, 57. This allows top flap 66 to be lifted up and folded out of the way so the user can easily remove the contents from carton 80 or eat directly from the carton.

Carton 80, as well as carton 2, is intended to be used without a protective wrapper or cover. Therefore, all printing is done directly on carton 2. To keep the printing from being scuffed or obliterated, an abrasion resistant coating 94 covers most of outer surface 22. However, selected regions 96, 98 and 100, shown partially shaded in FIG. 4, are not covered with coating 94. Rather, regions 96, 98 and 100 are coated with the heat-sensitive material covering outer surface 22 of the embodiment of FIG. 1. Regions 96, 98 and 100 allow the adhesion of the portion of web corners 18–21 on either side of diagonal crease 26, of side flaps 50, 51 to sides 17, 15 and of portions of front flap 52 to side 16.

Side 16 includes a depressed or compressed area 102 (see FIG. 5) positioned to underlie an outer portion 104 of top flap portion 82 so that portion 104 can be easily lifted away from side 16. Further, substantially all of compressed area 102 is devoid of heat-sensitive material 101 so to further aid the easy lifting of tab 58. Side 16 also includes a tab slit 106 for insertion of tab 58 to keep top flap 66 in place after top flap 66 has been lifted away from top 44, such as while cooking food 8.

Lifting tab 58 of carton 80 is sized so that its outer edge 108 lies generally even with or slightly past bottom 10. That is, a distance 110 between third edge 48 and outer edge 108 is preferably substantially equal to or slightly greater than a distance 112 between an edge portion 114 of bottom periphery 12 and an outer edge 116 of side 16. This permits the user to easily grasp tab 58 by simply inserting one's fingernail under outer edge 108 of tab 58.

Modification and variation can be made to the disclosed embodiments without departing from the subject of the invention as defined in the following claims. For example, an adhesive other than a heat sensitive coating can be used.

I claim:

1. A microwave carton comprising:

a one piece body including:

a base portion including a bottom having corners and a bottom periphery, sides extending from the periphery and web corners between the sides at the corners, the base portion being creased along the base periphery, at the intersection of the web corners and at the sides and centrally along the web corners and at the sides and centrally along the web corners so to aid folding the sides normally to the bottom, the bottom, the sides and the web corners providing a seamless, liquid containing carton bottom;

a top, having first, second, third and fourth edges, the top integrally connected to and extending from an outer edge of one of the sides at the first edge, the top sized to overlie the bottom;

a front flap extending from the third edge, the third edge being opposite the first edge;

side flaps extending from the second and fourth edges;

the top and the front flap together including a top flap, the top flap having a lifting tab at an outer edge of the front flap;

first and second tearable joints extending from the lifting tab to the third edge, from the third edge along paths generally parallel to and spaced apart from the second and fourth edges respectively, and to transition area positions spaced apart from the first edge so to define said top flap and a U-shaped strengthening region of said top, the top flap overlying a substantial portion of the bottom; and crease segments between the front flap and the top, the crease segments spaced apart from the score lines.

2. The carton of claim 1 wherein a full strength top flap transition area is defined between said transition area positions.

3. The carton of claim 1 wherein the first tearable joint includes an upper score line and lower score line, the lower score line being generally parallel to but spaced apart from the upper score line, the intersections of the top and the outer side edge, the side flaps and the front flap being creased to aid folding at said intersections.

4. The carton of claim 1 further comprising tab means at the sides and the web corners for mechanically interlocking adjacent sides and web corners with said sides transverse to the bottom.

5. The carton of claim 4 wherein the tab means includes a tab on the sides for folding inwardly over a notch formed in the outer edges of the webs, the tab having ears so that a portion of the tab is wider than the width of the slot.

6. The carton of claim 1 wherein the front flap and the lifting tab have outer edges, the lifting tab outer edge extending past the front flap outer edge.

7. The carton of claim 1 wherein a surface of the body has a water repelling coating chosen to withstand temperatures generated during microwave cooking.

8. The carton of claim 1 wherein a surface of the body has a water repelling, heat sealable coating.

9. The carton of claim 8 wherein the coating is on one side of the body.

10. The carton of claim 8 wherein portions of the front and side flaps are heat bonded to the sides through the heat sealable coating.

11. A folded carton comprising:

a bottom portion including a bottom, first, second, third and fourth upstanding sides and corners;

a top portion extending from an outer edge of the first upstanding side, the top portion including a top, a front flap and tearable joints in the top and front flap defining a top flap portion, the top flap portion including a lifting tab, the lifting tab being a part of the front flap and lying adjacent the second upstanding side;

the tearable joints including upper and lower, spaced apart score lines;

crease segments between the front flap and the top, the crease segments being spaced apart from the score lines; and means for securing the top portion to the bottom portion.

12. The carton of claim 11 wherein the lifting tab is sized so the outer tab edge extends to a position at least about even with the bottom so the lifting tab can be easily grasped.

13. The carton of claim 11 wherein the top portion includes a top and side flaps, the top overlying the bottom and the side flaps positioned adjacent the third and fourth upstanding sides.

14. The carton of claim 11 wherein the second upstanding side includes a depressed surface area underlying at least a portion of the lifting tab.

15. The carton of claim 11 wherein a portion of the front flap adjacent the lifting tab is cut away.

16. The carton of claim 11 wherein the tearable joints extend from the lifting tab along the front flap at an angle of about 45° to the bottom.

17. The carton of claim 11 wherein the second side includes a lifting tab slit for receipt of the lifting tab to resecure the top flap portion to the remainder of the carton after the top flap portion has been torn away from the remainder of the top portion.

18. The carton of claim 14 wherein the top portion includes a top overlying the bottom, side flaps adjacent the third and fourth upstanding sides and a front flap adjacent the second upstanding side, and wherein the securing means includes an adhesive securing the second and fourth upstanding sides to the side flaps and wherein the depressed area is substantially free of the adhesive.

19. The carton of claim 11 further comprising tab means at the upstanding sides and the corners for mechanically interlocking adjacent upstanding sides and the corners.

20. The carton of claim 19 wherein the corners include webs and the tab means includes a tab on the sides for folding inwardly over a notch formed in the outer edges of the webs, the tab having ears so that a portion of the tab is wider than the width of the slot.

* * * * *